United States Patent [19]

Kleinholz

[11] Patent Number: 4,566,619

[45] Date of Patent: Jan. 28, 1986

[54] PNEUMATIC FASTENER-DRIVING TOOL AND METHOD

[75] Inventor: Edward O. Kleinholz, Yucca Valley, Calif.

[73] Assignee: The Kiesel Co., St. Louis, Mo.

[21] Appl. No.: 664,944

[22] Filed: Oct. 26, 1984

Related U.S. Application Data

[63] Continuation of Ser. No. 171,720, Jul. 24, 1980, abandoned, which is a continuation-in-part of Ser. No. 84,367, Oct. 12, 1979, abandoned, which is a continuation of Ser. No. 899,514, Apr. 24, 1978, abandoned.

[51] Int. Cl.[4] ..... B25C 1/04; B25C 7/00

[52] U.S. Cl. ..... 227/8; 29/432.1; 173/139; 206/347; 227/66; 227/93; 227/95; 227/115; 227/130; 227/136

[58] Field of Search ..... 29/432.1, 432.2; 173/139; 206/347, 345; 227/8, 66, 93, 94, 95, 114, 115, 116, 117, 130, 135, 136

[56] References Cited

U.S. PATENT DOCUMENTS

| | | | |
|---|---|---|---|
| 1,378,550 | 5/1921 | Miller | 206/347 X |
| 3,027,560 | 4/1962 | Nelson | 227/66 |
| 3,212,632 | 10/1965 | Baum et al. | 206/345 X |
| 3,438,449 | 4/1969 | Smith | 173/339 X |
| 3,438,487 | 4/1969 | Galee et al. | 206/347 |
| 3,491,932 | 1/1970 | Novak | 227/136 |
| 3,774,293 | 11/1973 | Golsch | 227/66 X |
| 3,774,833 | 11/1973 | Deshich | 227/156 |
| 3,784,077 | 1/1974 | Burke, Jr. et al. | 227/8 |
| 3,905,535 | 9/1975 | Novak et al. | 227/120 |

*Primary Examiner*—Paul A. Bell

*Attorney, Agent, or Firm*—Edward R. Weber

[57] ABSTRACT

A pneumatically operated fastener-driving tool, particularly adapted for nailing drywall to the framing of a building, includes a housing, a reciprocator assembly mounted within the housing, and a piston mechanism mounted within the reciprocating assembly for axially driving the fastener into the drywall and underlying framing member. Upon actuation of the tool, the piston is pneumatically driven through a fastener-driving stroke and the reciprocator is reactively driven in an opposite direction. The oppositely driven reciprocator assembly absorbs recoil energy during the piston's driving stroke without transmitting an appreciable amount thereof to the housing, thereby substantially precluding housing recoil during driving of the fastener. At the end of the driving stroke, the reciprocator engages and is decelerated by the piston, thereby reducing housing recoil subsequent to the driving of the fastener. At the end of its driving stroke, the piston mechanism recesses the fastener in the drywall and engages a dimpler member to form a shallow recess around the driven fastener.

20 Claims, 20 Drawing Figures

FIG. 18.
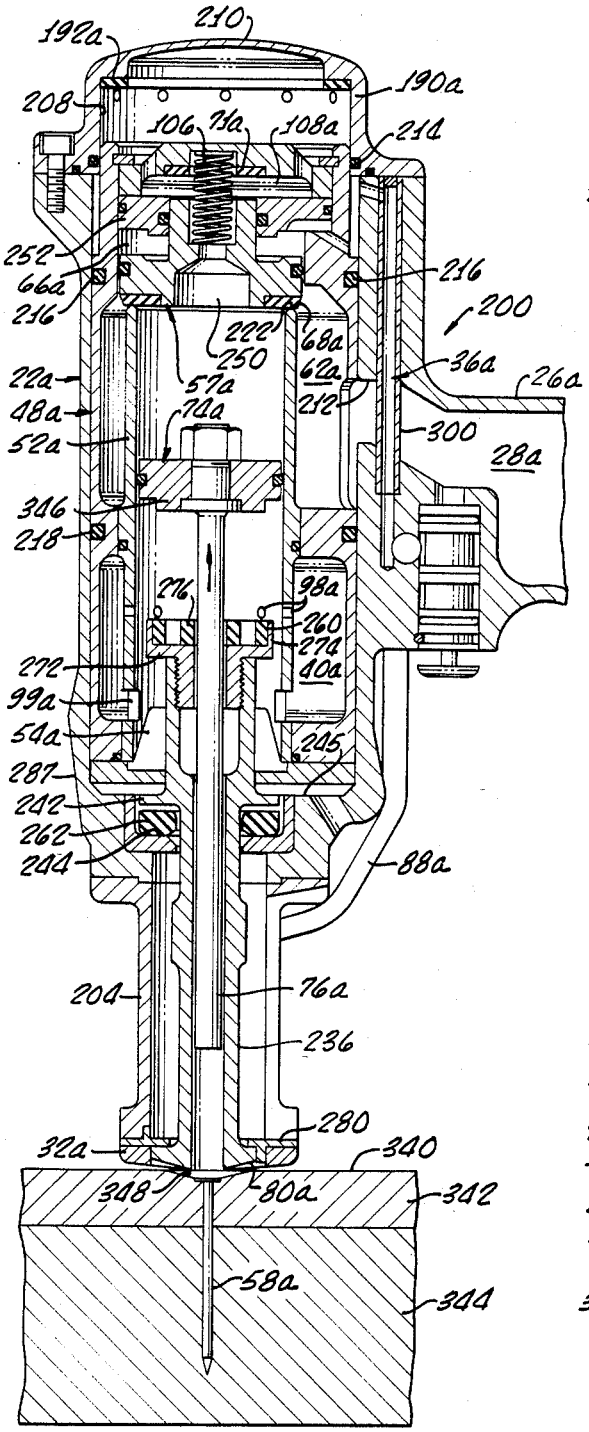
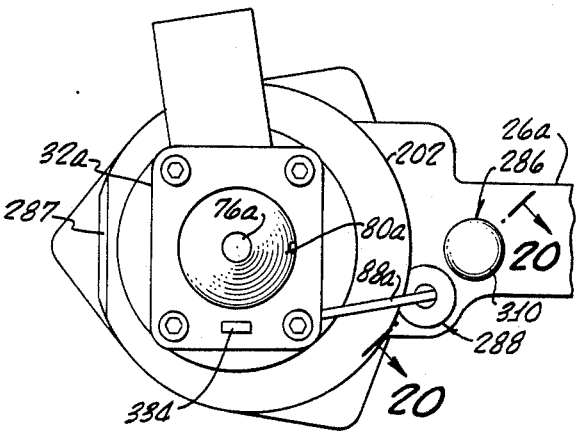
FIG. 19.
FIG. 20.
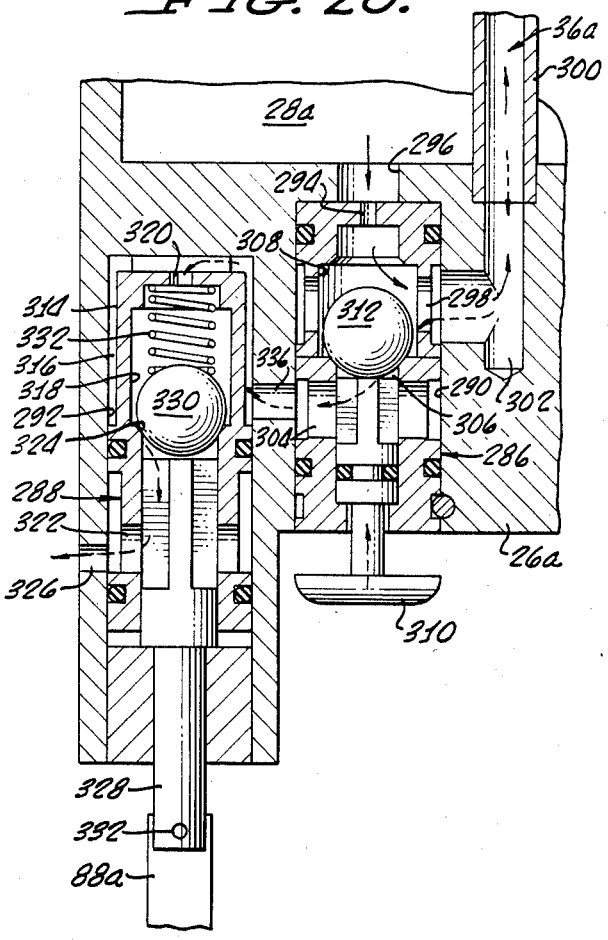

PNEUMATIC FASTENER-DRIVING TOOL AND METHOD

This is a file wrapper continuation of application Ser. No. 171,720, filed July 24, 1980, now abandoned which is a continuation-in-part of application Ser. No. 084,367, filed Oct. 12, 1979 (now abandoned), which was a continuation of application Ser. No. 899,514, filed Apr. 24, 1978 (now abandoned).

BACKGROUND OF THE INVENTION

1. Field of the Invention

This invention relates to pneumatically operated apparatus and systems for driving fasteners.

2. Description of Prior Art

Pneumatic fastener driving tools are widely used in the building industry to join structural components together. The tools commonly employ a piston type drive mechanism which, during its driving stroke, engages one of a series of fasteners fed to the tool to force the fastener into the components to be joined.

Various attempts have been made to use pneumatic tools of this type as nailers to secure drywall sheets to framing studs in the construction of walls. In the fastening of drywall or other wallboard sheets to wooden framing studs, three criteria must typically be met for approval of the wall construction under applicable building codes and to provide a smooth finished wall surface. First, the head of each of the driven drywall nails must be recessed in the drywall to a depth within a specified range. Secondly, it is necessary or desirable to dimple or slightly recess the drywall around the recessed heads of the driven nails so that the nail heads can be concealed with spackling or the like subsequently deposited in and around each of the dimples. Thirdly, each of the mounted drywall sheets must be held in firm abutment with each of its framing studs at each nail location.

Several pneumatic tools have been proposed to perform these multiple functions in a single operation—i.e., to simultaneously drive the nail and properly recess its head, form a dimple in the drywall around the nail head, and ensure a firm abutment between the drywall sheet and its supporting studs at each nail location. However, none of these prior art tools has satisfactorily accomplished these multiple functions.

The chief reason for the failure of conventional pneumatic fastener drivers to satisfactorily drive, recess, dimple and secure in one operation is that they recoil away from the drywall at the instant they are actuated. This heretofore unavoidable recoil renders it difficult to control the depth of either the nail recess or the dimple since as the nail-driving and dimpling mechanisms are being driven toward the drywall, the tool itself is being reactively thrust away from it. The nail recess and dimple depths are thus functions of the force with which the tool's operator presses it against the drywall during firing to limit recoil.

Therefore, with conventional fastener driving tools, the achievement of uniform recess and dimple depths usually requires a rather high degree of skill and experience on the part of the tool's operator. Too little contact pressure between the conventional tool and the outer drywall surface results in unacceptably shallow nail recesses and dimples (or the lack thereof) while excessive pressures can cause breakage of the drywall. Either situation can result in rejection of the resulting wall structure by a building inspector, and the necessity to rebuild it.

Tool recoil upon actuation can also cause loose connection points between drywall and studs (and, thus, a similar rejection of the wall by a building inspector) even though proper nail recesses and dimples have been formed. It is usually the case that the nailing surfaces of the studs (i.e., the surfaces which the inner surfaces of the installed drywall sheets must abut) are neither perfectly flat nor exactly coplanar. Thus, at many nail locations, a gap exists between the stud nailing surface and the inner surface of the drywall prior to the driving of nails at such locations. If the drywall is not pushed inwardly and held firmly against the stud while a nail is being driven into the stud, at least a portion of this gap remains after the nail is driven and the spackling is applied to its surrounding dimple. Subsequent inward pressure against the drywall (for example, when it is inadvertently bumped) can cause inward movement of the drywall relative to the stationary nail which causes the nail's head to pop the spackling out of its dimple and ruin the wall's finish.

To prevent this from occurring, it is necessary to press the tool against the drywall until the drywall is forced firmly against the underlying stud, and maintain the drywall-stud contact until the nail is completely driven. As in the case of trying to achieve uniform nail recess and dimple depths, this is made difficult by the rearward recoil of conventional pneumatic nailers at the instant of their actuation. If considerable pressure is not maintained between the tool and the drywall during firing, such firing recoil allows the drywall to spring out from the stud during firing so that the driven nail does not hold the drywall firmly against the stud.

Another problem associated with conventional pneumatic fastener drivers involves the nailing of drywall at the corners of a room. At the typical room corner, each of the drywall nails must be positioned less than an inch from the adjacent wall. With this rather small distance, it is difficult to provide a tool having sufficient power so that it is capable of accurately and forcefully driving a nail into the underlying studding while simultaneously forming a proper dimple in this awkward location.

Conventional pneumatic nailers are not noted for their durability. Particularly when such tools are inadvertently "dry fired" (i.e., when they are fired without adequate backup such as a framing stud), their fastener-driving and dimpling mechanisms are subjected to high stresses which cause rather rapid component fatigue and failure necessitating repairs and equipment downtime. This problem is particularly acute in tools in which there is metal-to-metal contact during either regular or dry firing of the tool.

In order to permit the nailing of a series of nails or other fasteners successively by an automatic tool, it has been previously proposed to secure the fasteners together in a "collation" of flexible assembly in which the nails or other fasteners are positioned in a row for successive pickup and use by the automatic fastening tool. Conventional collations involve the complete enclosing of a portion of each of the fasteners by the plastic or wire typically used to join the fasteners and form the collation assembly. Accordingly, when the fastener is driven into the wall or other parts to be joined, a portion of the plastic or wire joining material is frequently sheared off and embedded in the wall or other components, tending to mar the finished structure or otherwise diminish the consistency and effectiveness of the fastening process.

Accordingly, it is an object of the present invention to provide a pneumatic fastener driving tool which eliminates or minimizes above-mentioned and other problems.

SUMMARY OF THE INVENTION

A pneumatically powered tool and method are provided in which recoil is substantially eliminated during actual driving of a fastener from the tool into objects, such as a drywall sheet and an underlying framing stud, to be joined together. A novel mechanism within the tool postpones tool recoil until the fastener is completely driven, and additionally significantly reduces the delayed recoil occurring after the fastener is driven.

This unusual and long sought-after result allows even a relatively unskilled operator to hold the tool in firm contact with the drywall, thus holding the drywall directly against the stud, until the tool has completely performed its fastening task. Each driven fastener thus forms a drywall-to-stud connection point at which the drywall directly abuts the framing stud—even if the drywall must initially be deflected inwardly to contact the stud and would tend to spring outwardly during the use of a conventional pneumatic fastener-driving tool.

The unique recoil-delaying and minimizing feature of the tool, which permits it to be hand-held in contact with the drywall during the entire time in which the fastener is being pneumatically driven, also allows the tool to recess the fasteners and form spackling dimples around them to uniform depths despite variations in contact pressure between the tool and the drywall at different drywall-to-stud attachment points.

In a preferred embodiment, the tool comprises a housing; a reciprocator assembly mounted for linear movement within the housing; fastener-driving means, including a piston mounted within the reciprocator, for parallel linear movement relative thereto, for driving a fastener into a workpiece; and actuating means for penumatically forcing the fastener-driving means through a driving stroke and simultaneously reactively driving the reciprocator assembly in an opposite direction within the housing.

During the driving stroke of the piston, recoil energy is absorbed by and causes the opposite motion of the reciprocator assembly. No significant amount of this recoil energy is transmitted from the reciprocator assembly to the housing during the driving stroke of the piston. The housing, therefore, remains substantially stationary during the actual driving of the fastener.

Subsequent to the driving stroke, a portion of the recoil energy in the oppositely moving reciprocator assembly is frictionally transmitted to the housing without impingement of the reciprocator assembly against the housing. The remainder of the recoil energy within the reciprocator assembly is transmitted not to the housing, but to the fastener-driving means which perform the unique dual functions of the driving the fastener and subsequently cooperating with the reciprocator assembly to significantly reduce the total amount of tool recoil—a recoil which has been postponed until the fastener is already driven.

This cooperation between the fastener-driving means and the reciprocator assembly, which aids in stopping the oppositely moving reciprocator within the housing, is accomplished by energy-absorbing means carried by the reciprocator assembly in fixed relation relative thereto. Subsequent to completion of the piston's fastener-driving stroke, these means collide with the piston and decelerate the reciprocator assembly.

According to a feature of the invention, dimpler means are provided for forming a rounded workpiece surface dimple around the fastener as it is being driven. In one form, the dimpler means has a work-engaging face that has two tapered surfaces, one extending toward the handle of the tool and making an angle of approximately 14°(plus or minus about 4°) and a second angle extending forwardly from the center of the dimpling surface and making an angle which is approximately 5° less than that of the rearwardly extending tapered surface, so that the dimple formed when the tool is oriented on a surface perpendicular to the axis of the driving piston is substantially the same as when the tool is tilted back slightly to apply fasteners to drywall sheets positioned in the corner of the room. In another form, the work-engaging face has a uniformly curved surface which permits the tool to form acceptable dimples in the drywall surface despite tilting of the tool to a slight degree in any direction during the fastening process.

Structural means may be provided for guiding and positioning the tool against a corner wall during the driving of fasteners into the adjacent corner wall to form proper dimples in such adjacent wall.

According to another feature of the invention, resilient means are provided for preventing rigid collision during the fastening process between the fastener-driving means, the dimpling means, and the housing to thereby greatly prolong the life of the tool and prevent damage to its components even during dry firing of the tool.

In accordance with another aspect of the invention, a collation, or series of fasteners which are mechanically held together by flexible plastic or wire material for ease in feeding by the tool, is provided. The collation has a configuration which avoids the carrying into the workpiece of any residual portion of the extended collation material. Preferably, to accomplish this function, the collation material has a release slot extending along the surface of each fastener shank so that the fastener may be readily detached from the collation and the collation material may be disposed of without inclusion into the assembly being fastened together.

In accordance with additional aspects of the invention, (1) the reciprocator assembly may be provided with an inner cylinder in which the piston is mounted, and a poppet valve assembly positioned at an open end of the cylinder which normally prevents the actuation of the piston, and which is pneumatically opened to initiate the driving action of the piston at the beginning of each cycle of operation of the tool; (2) the reciprocator and the piston are returned to their ready-to-fire positions following each power cycle by pneumatic means which also apply closing force to the poppet valve; (3) the energy-absorbing means carried by the reciprocator assembly comprises a resilient bumper positioned at a forward end of the reciprocator assembly; (4) the reciprocator assembly is provided with a surge reservoir for initially supplying driving power to the piston; (5) a reservoir chamber is provided in the housing through which pressure is developed to return the reciprocator assembly and piston to their ready-to-fire positions, and from which a fastener feeder is driven; (6) the housing is provided with a dimpler retaining (and guiding) cap around the periphery of the dimpler and the dimpler may be pressed back into the retaining cap to enable operation of the tool and to assure uniform dimpling; and (7) safety interlock means, including a safety interlock member extending between a forward end of the housing and the actuating means, are provided to preclude firing of the tool unless the interlock member is in a depressed position.

BRIEF DESCRIPTION OF THE DRAWINGS

FIG. 18 is a view similar to FIG. 17 showing the piston and the reciprocator assembly being pneumatically returned to their ready-to-fire positions;

FIG. 19 is a bottom end view of the tool illustrated in FIGS. 16–18; and FIG. 20 is an enlarged cross-sectional view taken along line 20—20 of FIG. 19.

DETAILED DESCRIPTION

Figure 1:
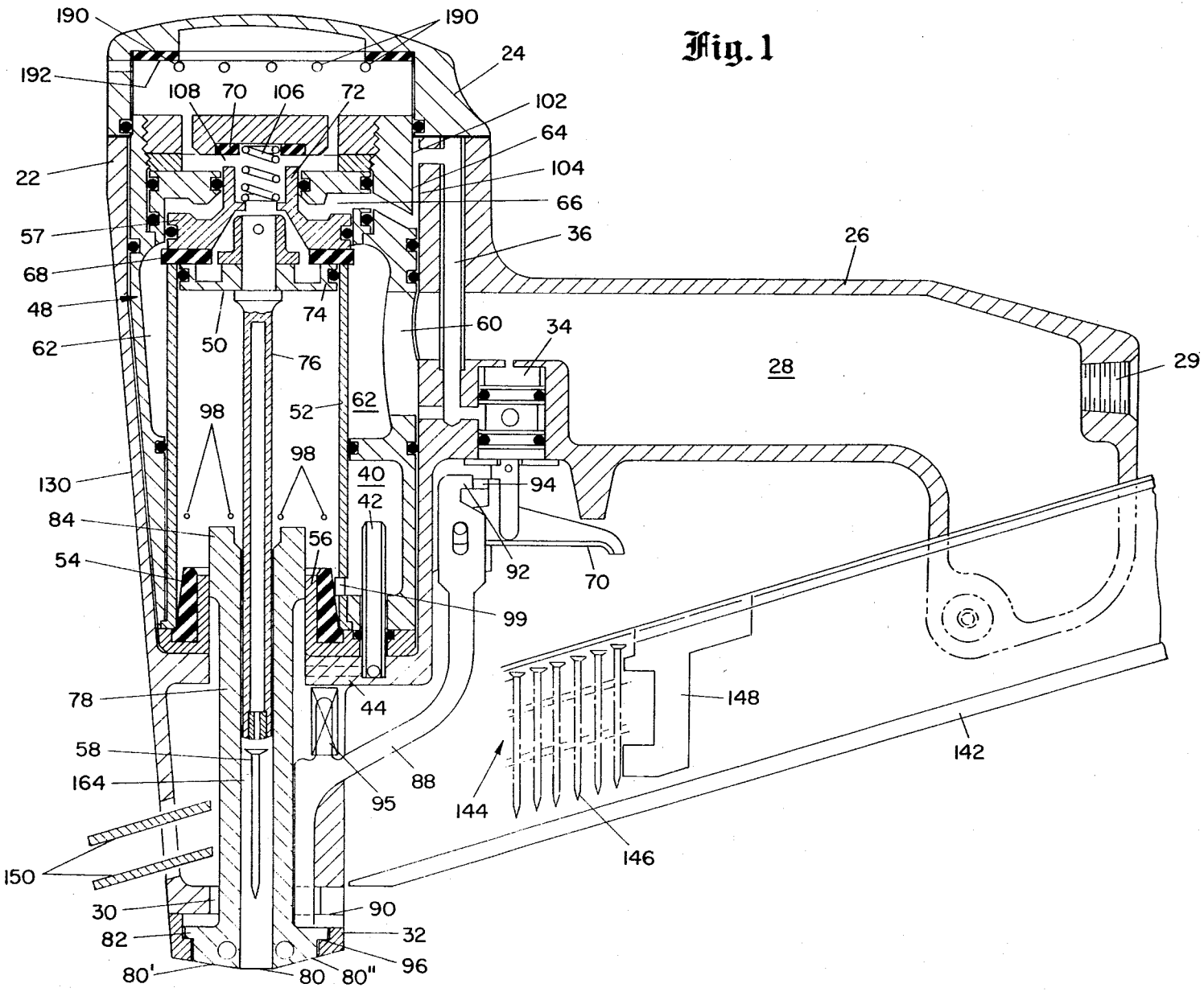
FIG. 1 is an overall view of a fastener driving tool embodying principles of the present invention.

FIG. 1 illustrates a pneumatically-powered fastener-driving tool embodying principles of the present invention and including a housing 22 and an upper head cover 24. The housing has an integral handle 26 by which the operator may grasp and manipulate the tool. The handle 26 is cored to provide a storage chamber 28 into which a pressurized gas, such as air, is introduced through opening 29 by a coupling connection from an external source to provide compressed air to various passages, valves and reservoirs for operating the tool as described in greater detail below. The housing 22 has a lower opening 30, and at the operating end of the tool, beyond the opening 30, a dimpler retaining cap 32.

The handle portion 26 has provision for retaining a manually operable actuation valve 34 and contains an air passageway 36, which serves to vent pressure and initiate operation of the tool as described below, when the valve 34 is operated.

A fastener progression mechanism 38 (see FIG. 4) is powered by air pressure from a reservoir 40 (see FIG. 1), through a transfer tube 42 and a passageway 44 leading to piston 46 to be described in greater detail below.

Now, returning to FIGS. 1 and 2, the presentation of FIG. 2 with the entire reciprocator assembly 48 and a fastener-driving piston assembly 50 shown separate from the enclosing housing, is intended to emphasize the essentially self-contained nature of the reciprocator and driving piston assembly. More specifically, with the piston 50 being mounted for movement within the cylinder 52 which is part of the reciprocator assembly, and finally abutting on the resilient stop 54 and the positive stop 56 at the end of its driving stroke, very little or substantially no recoil is transmitted to the enclosing housing 22 of the tool during such driving stroke. As mentioned above, as the driving piston 50 drives the fastener 58 (see FIG. 2) downwardly, and the piston moves down within the cylinder 52, the entire reciprocator assembly 48 moves upwardly within the housing 22. However, the reciprocator assembly is many times heavier than the driving piston, and accordingly only moves a fraction of the distance of the piston.

Figure 2:
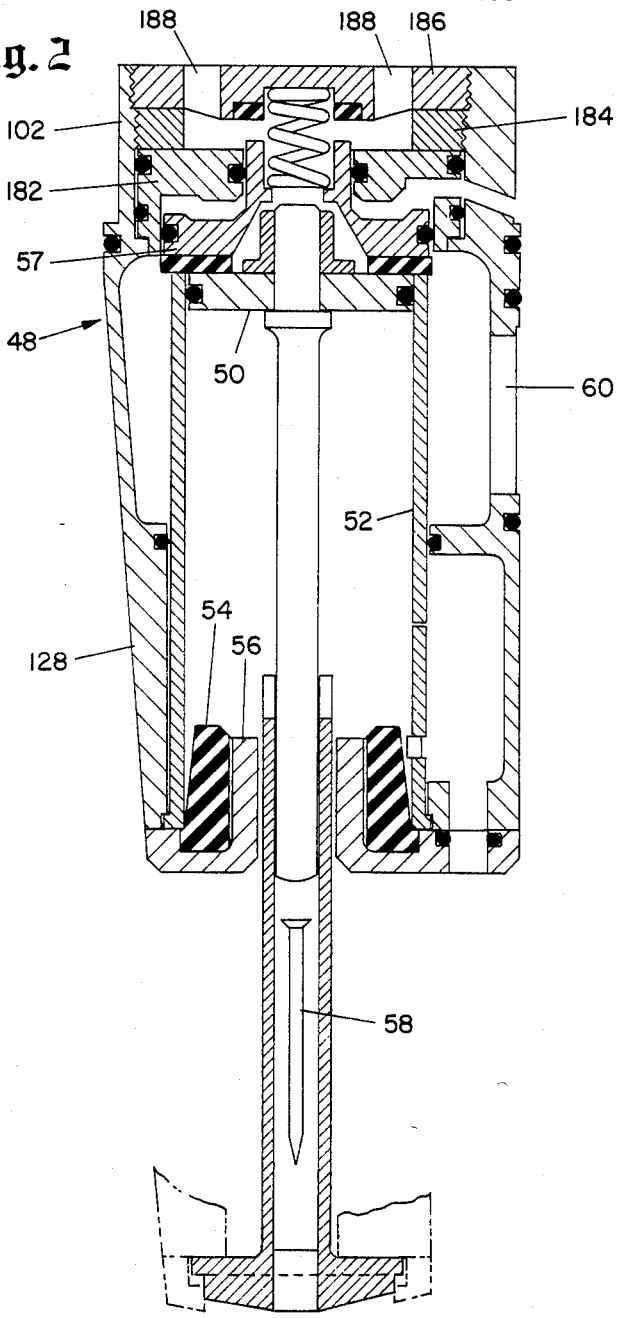
FIG. 2 is a showing of the central reciprocator, piston, and dimpling structure removed from the tool of FIG. 1.
Figure 7:
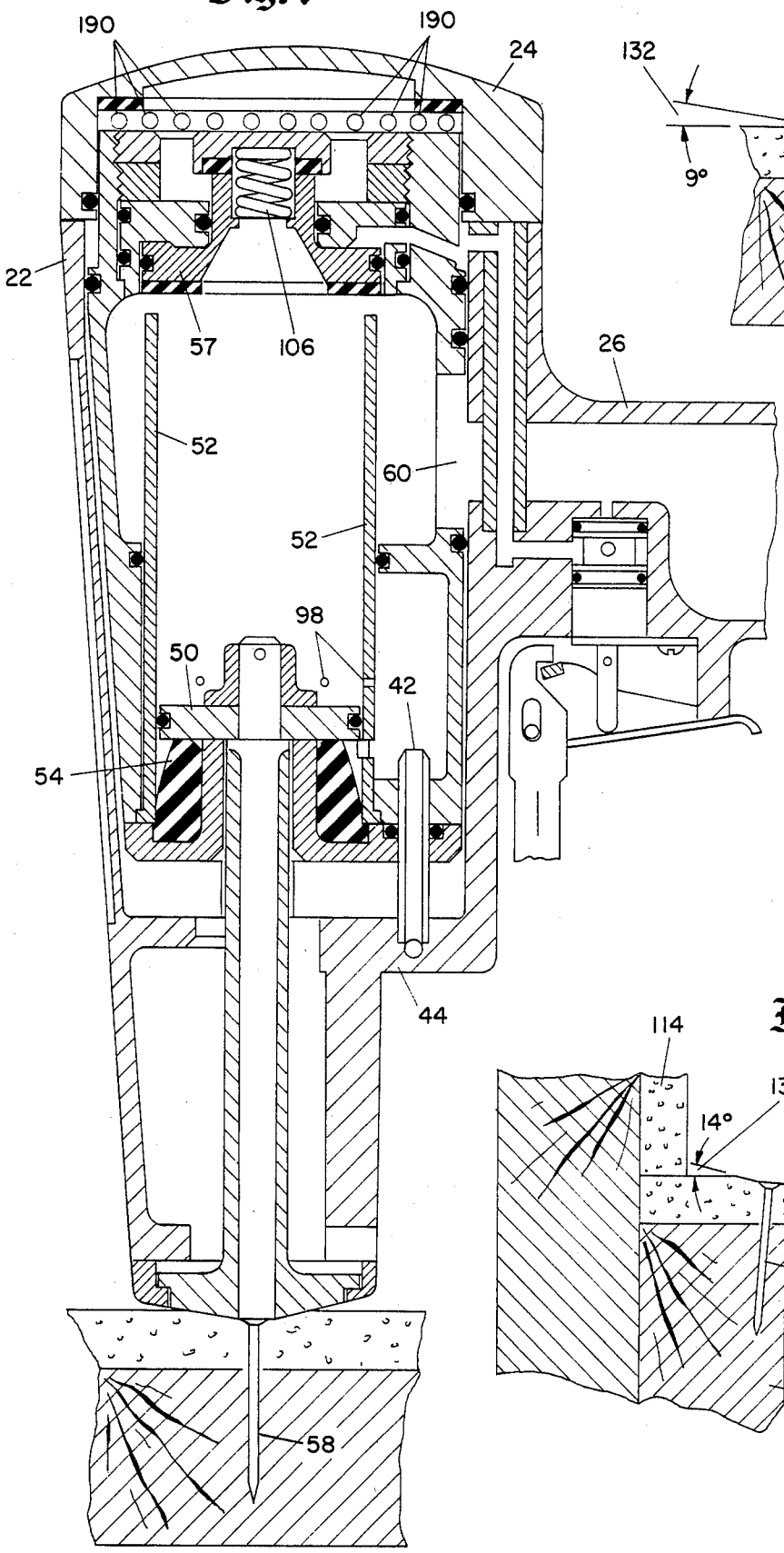
FIG. 7 is a detailed assembly view similar to the showing of FIGS. 1 and 2, but with the piston and the reciprocator in their most advanced and retracted positions, respectively.

Now, returning to the most basic mode of operation of the pneumatic portion of the system, with reference to FIGS. 1, 2 and also to FIG. 7, in the rest position, as shown in FIG. 1, a poppet valve assembly 57 is closing the upper end of the drive cylinder 52. At this stage of the cycle, high pressure air is supplied from the chamber 28 in the handle 26 through an opening 60 in the outer wall of the reciprocator assembly 48 into a surge chamber 62, formed within the reciprocator assembly, which circumscribes the cylinder 52. At this time high pressure air from the chamber 28 in the handle 26 is supplied through the valve 34 and the passageway 36 to a reciprocator return passageway 64 and into a poppet valve pressure chamber 66. The poppet valve assembly 57 and a seal 68, which it carries is therefore held firmly downward on the top of the cylinder 52.

Upon actuation of the trigger 70, however, the valve 34 is actuated to vent the air from passageways 36, 64, and from chamber 66, above the poppet valve. Then, with the area of the poppet valve assembly 57 and its associated seal 68, being slightly greater than that of the cylinder 52, the poppet valve assembly is rapidly moved upward to open the upper end of the cylinder 52 and to close the seal between the resilient seal member 71 and the cylindrical upper end 72 of the poppet valve assembly. Surging air from chamber 62 enters the cylinder barrel onto the piston head 74 of the piston assembly 50 in an explosion-like manner immediately following the rapid actuation of the poppet valve assembly. The piston assembly 50 with its associated fastener driver portion 76 is moved with high acceleration in the direction of the fastener 58. The fastener, upon being contacted, is forced into the workpiece, which may be drywall, and subsequently into the drywall supporting substructure.

As mentioned in the introduction of the present specification, following the nailing of a particular nail into drywall, it is desired that the drywall be dimpled or recessed so that the head of the nail may be spackled to prepare for the painting or wallpapering of the wall. Referring to FIG. 1, the dimpling is accomplished by the dimpler assembly 78 including the curved dimpling face 80, the movement-controlling flange 82, and the striking face 84. Initially, when it is desired to operate the tool, it must be placed in engagement with the drywall, or other workpiece into which the fastener is to be driven. An interlock structure including member 88 is provided to prevent operation of the trigger 70 until the dimpler assembly 78 is firmly in engagement with the workpiece and surface 80 is pressed so that movement determining flange 82 engages the overlying flange 90 in the nose of the housing 22. When this occurs, the interlock member 88 is moved upwardly so that the stop protrusion 92 no longer blocks actuation of trigger 70 by interfering with the motion of element 94 secured to the trigger assembly. With regard to the foregoing mode of operation, it may be noted that the spring 95 normally biases the interlock member 88 and the dimpler is pressed against the work into which the fastener is to be driven.

Following the driving of fastener 58, the lower surface of the piston 74 will engage the driving surface 84 at the upper end of the dimpling assembly 78. During the course of the driving of the fastener, the movement of the piston has been decelerated to some extent. Resistance due to dimple formation, as the surface 80 depresses the surface of the drywall board now causes considerable additional deceleration of the piston. Final deceleration occurs as the annular shoulder 82 engages the arresting ledge 96 in the nose of the housing 22, finalizing dimple depth and setting the fastener firmly in the workpiece.

Immediately after the deceleration of the fastener-driving piston assembly as noted above, resilient member 54 and positive stop member 56, which are secured to the lower end of the reciprocator assembly, engage the piston assembly 50. Since the piston assembly 50 is now resting upon the lower end closure of the reciprocator assembly 48, thrust forces are now equal between the piston and the reciprocator assembly and both are decelerated to a complete stop, and the tool is at the end of its work-stroke cycle.

During the work stroke, static air directly in the course of piston head 74 is transferred into the lower storage chamber 40 through a peripheral series of small openings 98 and several larger apertures 99. After the head 74 of piston 50 has passed the openings 98, and before pressure is released above the piston, additional pressurization of the piston return chamber 40 is provided through small openings 98.

This pressure which is built up is transmitted through tube 42 to the mechanism 38 which removes a fastener from the collation and inserts it into the driving chamber, in the position shown by fastener 58 in FIG. 1, for example. Details of this operation will be developed below.

After completion of the work stroke the system is in the position shown in FIG. 7 of the drawings. The trigger 70 is then released by the operator. At the instant of trigger release, the normally open control valve 34 receives compressed air from the reservoir 28 in the handle 26, and the higher pressure is transmitted through passageway 36 to the reciprocator assembly return compression chamber 64 and subsequently into the poppet valve pressure chamber 66.

It may be recalled that the entire reciprocator assembly 48 has been moving upwardly, as the piston has been moving down. In order to return the reciprocator assembly to its lower position, ready for the next stroke, the reduced diameter of the upper portion 102 of the reciprocator assembly relative to the diameter of the passageway 104 provides the necessary piston area for downward force to be applied from the peripheral reciprocator assembly return compression chamber 64. Simultaneously, poppet valve compression chamber 66, upon receiving pressure, and with the assistance of the compression spring 106, will shift the poppet valve assembly 57 to the position shown in FIG. 1 in which the power cylinder exhaust port 108 at seal 71 is opened, and the upper end of the power cylinder 52 is closed, removing high pressure from the upper surface of the piston head 74. The compressed air from the chamber 40 will now apply pressure to the lower surface of the piston head 74, and return it to its position as shown in FIG. 1.

Now that the basic mode of operation of the system has been described, attention will be directed to some of the other features of the present invention.

Figure 8:
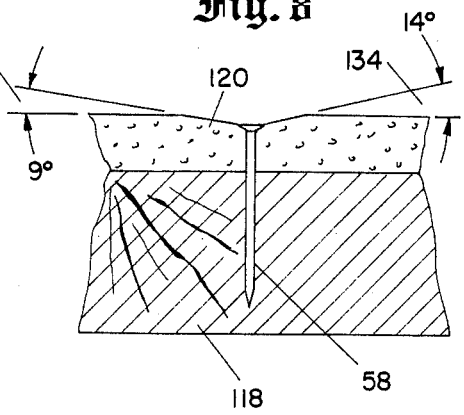
FIGS. 8 and 9 show the dimpling action of the tool of the present invention, both in connection with a flat surface nail insertion (FIG. 8), and in connection with the insertion of the nail into studding at the corner of a room (FIG. 9)
Figure 9:
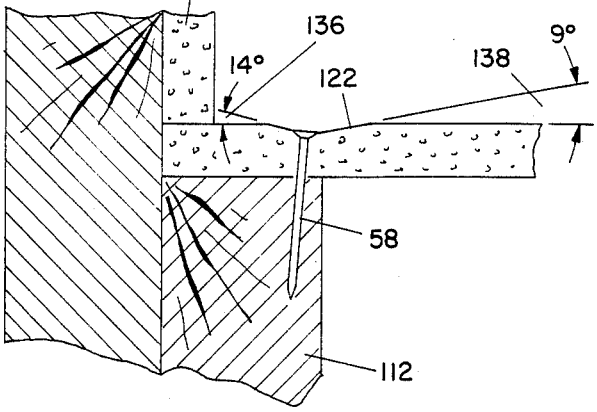

A number of structural features of the present invention are directed to the situations shown in FIGS. 8 and 9 of the present drawings; and to the particular problem posed by FIG. 9, that of driving a fastner into a stud at the corner of a room. In FIG. 9, a nominal two by four 112 is shown, and it has a thickness of approximately one and one-half inches. With the drywall 114 in place, the extent of the two by four 112 from the surface of drywall 114 is only about one inch. The problem of providing a sufficiently powerful fastener-driving tool which is mechanically sound and which will accomplish the needed job has been one which has plagued the industry for many years. In the following portion of the present specification the design features which contribute to an effective accomplishment of this difficult job will be developed.

FIG. 8 is included by way of contrast to show the securing of a fastener 58 through the drywall sheet 116 into studding 118. In addition, the dimple 120 to which spackling will be applied, may also be noted. Similarly, the dimple 122 in FIG. 9 may also be noted, and the details of the formation of these two dimples will be discussed in greated detail below.

Figure 3:
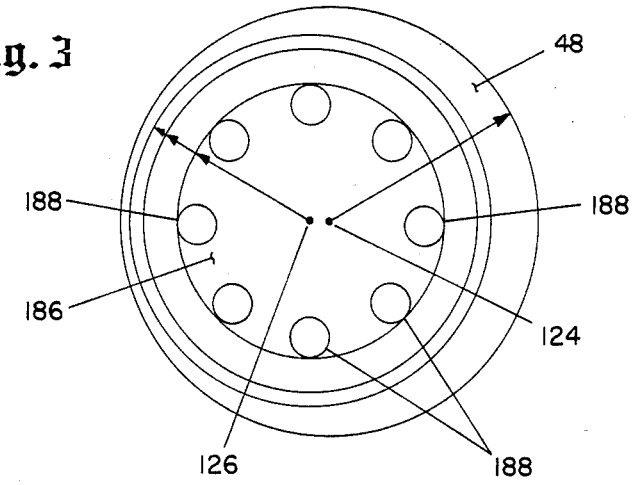
FIG. 3 is an end view of the reciprocator and piston assembly of FIG. 2.

One feature of the present invention which contributes to the mode of operation by which a fastener may be powerfully driven into drywall and underlying studding in the corner of a room, involves the location of the driving piston eccentrically in the containing reciprocator assembly, as best shown in FIG. 3 and the associated FIG. 2. In the diagram of FIG. 3, the center of the reciprocator assembly is shown at point 124. The center of the cylinder 52 and the axis of movement of the piston 50 is located at point 126, however, somewhat shifted away from the axis 124. Of course, although spaced, these two axes are parallel.

This shifting of the axis of movement of the cylinder is for the purpose of permitting the drive piston to be closer to the adjacent wall when fasteners are to be driven into the corner of a room. In order to further work toward this goal, one face 128 of the reciprocator assembly (see FIG. 2), is tapered, and this tapering occurs on the side of the reciprocator assembly toward which the inner eccentrically mounted drive piston is located. This inner construction is manifested on the outer surface of the tool housing 22 the area 130 which is similarly tapered. This area 130 appears in FIG. 4 as a triangular area by which the generally cylindrical outer configuration of the housing 22 is modified. This angle by which the one face 130 of the housing 22 is tilted with respect to the axis of the power piston, may be approximately five degrees, although somewhat greater or lesser angle may be employed.

Figure 6:
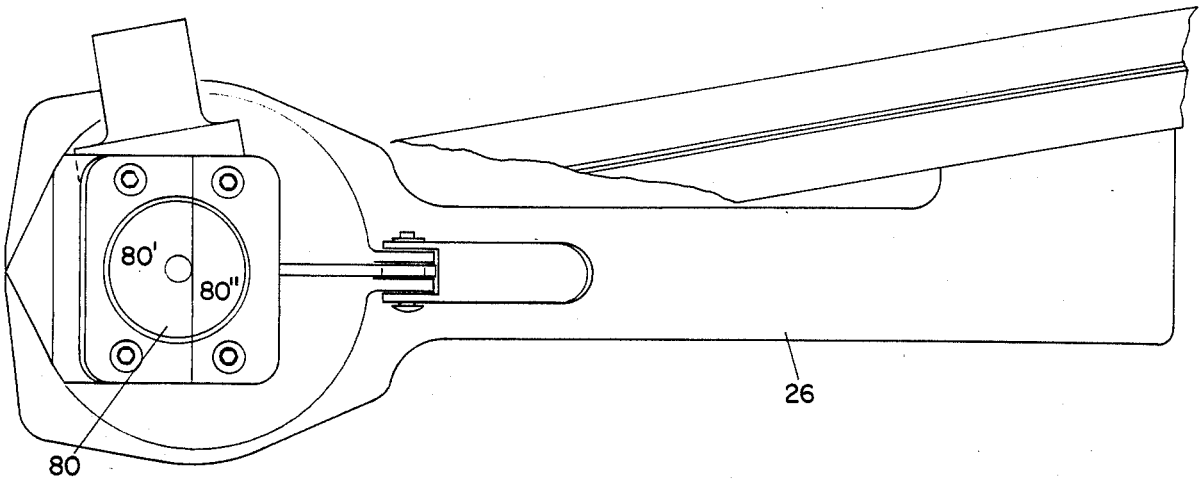
FIG. 6 is a bottom view of the tool of FIG. 1, showing the dual tapering of the dimpler mechanism.

Now, the configuration of the dimpler face 80 on the dimpler assembly 78 will be considered. The dimpler face 80 has a complex curved shape, with the portion 80' being conical but with one cone angle, and the portion 80'', as shown in FIG. 6 having a slightly different conical angle. More specifically, with the axis of the driving piston assembly 50 being perpendicular to the work surface, the surface 80' away from the handle 26 may make an angle of approximately nine degrees with the work surface, while the surface 80'' may make an angle of approximately fourteen degrees with respect to the drywall or other work surface.

With the arrangement and configuration of the dimpling surface 80 as described above, and with the tapered face 130 on the housing 22 making an angle of five degrees relative to the axis of the piston assembly 50, the origin of the angles indicated in FIGS. 8 and 9 should become apparent. Specifically, with the axis of the drive piston 50 being perpendicular, as shown in FIG. 8, the nail 58 is driven perpendicularly into the drywall 116 and the underlying studding 118, and the surface formed by dimpler surface 80' makes an angle 132 equal to nine degrees with the outer surface of the drywall 116. In addition, the angle 134 which is formed by surface 80'' is equal to fourteen degrees. However, with reference to FIG. 9, the nail 58 in this Figure is driven by applying the surface 130 of the housing 22 against the wallboard sheet 114 in FIG. 9. Accordingly, the nail 58 is driven in at an angle of five degrees relative to the vertical, the angle 136 is equal to fourteen degrees, and the angle 138 is equal to nine degrees.

After considerable experimentation, it was determined that good dimpling action could be achieved, without ripping or otherwise tearing the surface paper on the wallboard, both for the vertical driving orientation and also for the angled orientation as indicated in FIG. 9. In addition, through the use of the eccentrically-mounted piston in the reciprocator assembly, together with the tapered reciprocator assembly and the tapered outer surface of the tool housing, the tool could be automatically located and properly oriented in the corner of a room as fasteners are driven. Further, as mentioned elsewhere, the driving action is both powerful and without significant recoil, while concurrently successfully recessing or dimpling the location of the fasteners to precisely the right depth, without the need for skilled workmen.

Attention will now be directed more closely to the arrangements for feeding fasteners into the fastener driver tool. In this connection attention is again directed initially to FIG. 1 in which the nail or fastener magazine 142 is shown carrying the collation 144 of nails 146. Forcing the nails to the left in the showing of FIG. 1 is the spring biased follower 148 which rides inside the magazine 142. To the left in FIG. 1 is shown the expended collation media 150.

Figure 10:
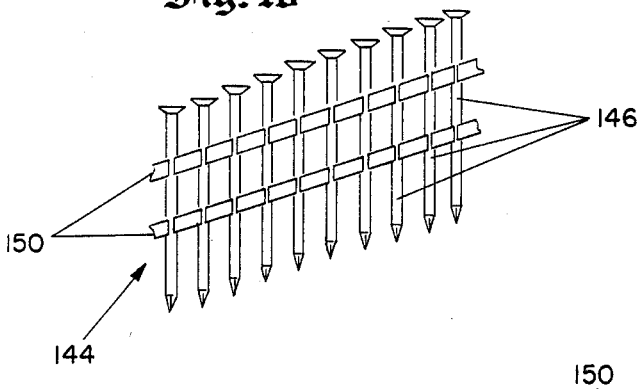
FIG. 10 is a collation which may be employed in connection with the present invention.
Figure 11:
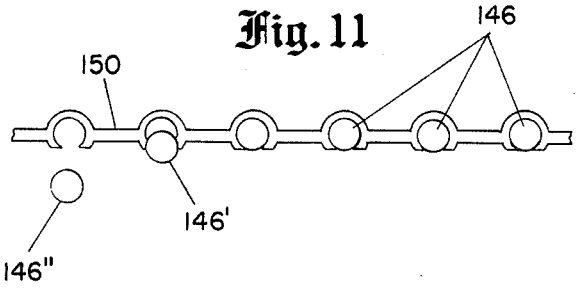
FIG. 11 is a sectional view taken through the nails and toward the collation of FIG. 10.

FIG. 10 shows the collation 144 including the nails 146 and the collation media 150 separate from the magazine 142. As shown in FIG. 11, the collation material 150 is cut away or otherwise removed along one side, substantially tangent to the surface of the nails 146. This permits easy removal of the nails as disclosed above by pressure applied transversely in accordance with the showing of FIG. 11 to move the nails 146 out from the collation supporting strips 150 as indicated by nails 146' and 146''.

Figure 4:
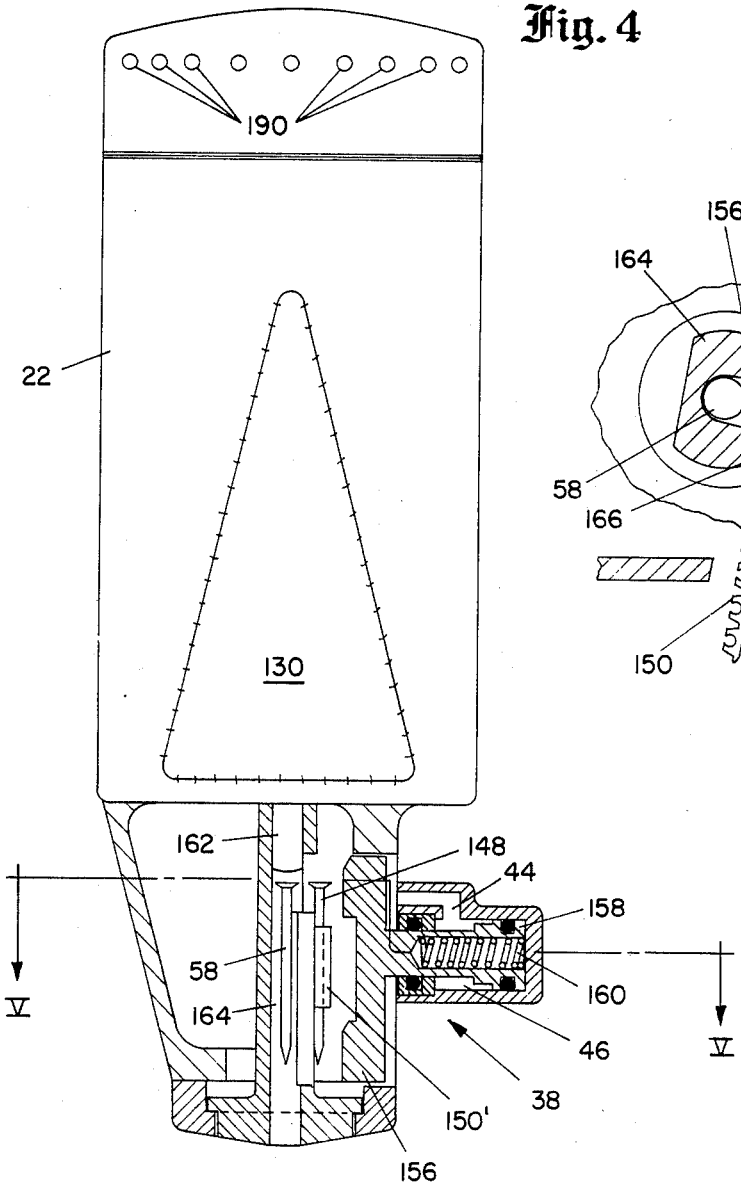
FIG. 4 is a front view of the tool of FIG. 1 taken from the side opposite the handle.
Figure 5:
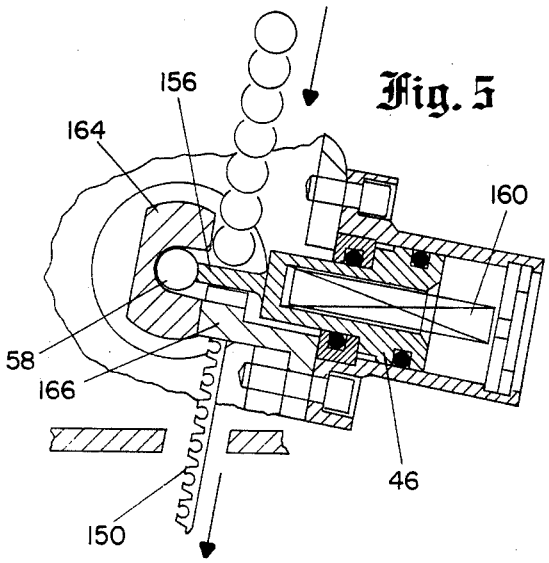
FIG. 5 is a view taken along lines V—V of FIG. 4.

The mode of operation of the mechanism for removing the nails from the collation strip material 150 will be discussed primarily in connection with FIGS. 4 and 5 of the drawings, with reference also being made to FIG. 1. Initially, FIG. 4 shows a nail 58 in position for driving, and the next nail 58' to be inserted still being held by the collation material 150 which may be either in the form of a single strip (see FIG. 12), or a pair of strips as shown at 150 in FIG. 10 and also in FIG. 1. In either event the open side of the collation from which the nails 146 may be easily removed is to the left as shown in FIG. 4. The pneumatically operated push bar 156, is in the retracted position in view of the force applied through passageway 44 to actuate the piston 46 to the right as shown in FIG. 4, and to compress the power spring 160. For convenience of illustration, the lower end 162 of the driving piston rod is shown immediately above and prepared to engage the head of the nail 58, in FIG. 4 in the position it will have prior to, and at the time of, actuation; however, the actual retraction of the piston 46 does not occur until the power stroke is initiated. Of course, as soon as the piston assembly 50 is retracted, and after the pressure in chamber 40 drops, and the power spring 160 forces the nail insertion bar 156 forward to move the next nail 58'(FIG. 5) into the tool fastener receiving raceway or channel 164 which is within the dimpler 78. As shown in FIG. 5, the nail insertion bar 156 holds the nail 58 by the head until it is driven forward by the head 162 of driver piston assembly 50.

Figure 12:
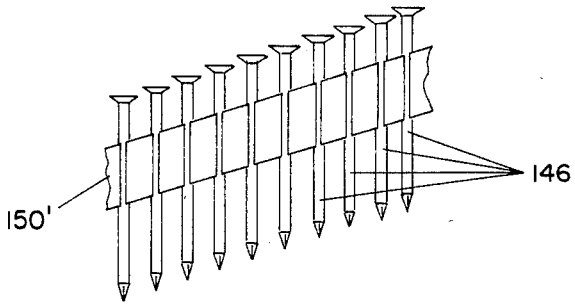
FIGS. 12 and 13 are side and cross-sectional views, respectively, of an alternative form of collation using a single strip of plastic.

A stop member 166 is provided to extend across the path of the collated fasteners between the collation strips 150 or above and below the collation strip 150' if a single strip of the type shown in FIG. 12 is employed.

Figure 13:
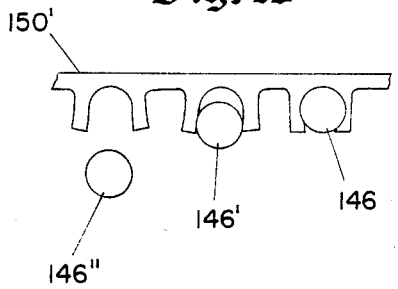

As mentioned above, the single plastic strip shown at 150' in FIG. 12 may be employed to hold the collated nails 146, instead of the dual strips 150 as shown in FIG. 10. A top view of the strip 150' together with nails 146, 146', and 146'' being removed from the strip is shown in FIG. 13.

Figure 14:
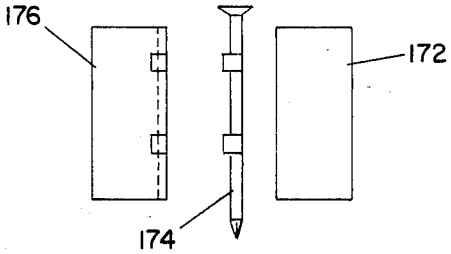
FIG. 14 is a diagrammatic showing of an apparatus for forming the collation of FIGS. 10 and 11.

FIG. 14 is a schematic showing of a process for providing a partial break in continuous double collation strips of the type shown in FIG. 10. More specifically, fasteners are currently available using double plastic strips of the type shown in FIG. 10, with no breaks adjacent the sides of the nail. This break which is shown in FIG. 10 and which is of the type shown in FIG. 12 and 13 may be introduced into presently existing collation arrangements by the use of a hot-forming plate 172 which may be pressed against the side of the collated nails 174 as they are engaged on the other side by the unheated or cold plate 176. Using this type of arrangement, the hot plate may engage each nail successively on its side to create a tangential slot along the side of the nails to permit easy removal. With this type of slot, as shown in FIG. 10, and also in the solid web arrangement of FIGS. 12 and 13, the fasteners may be readily removed from the collation strip and the nails pounded into place with no accompanying residue from the collation strip to interfere with or mar the surface of the members to be secured together.

Incidentally, in many of the structures described in the present specification, where the reciprocator is slidably mounted within the housing, or where the piston is slidably mounted within the cylinder, low friction high quality seals are required. These may be provided by known techniques involving the use of Teflon strips or rings which are relatively thin, and which are backed up by rubber O-rings to apply sealing pressure to the Teflon material which actually contacts the opposing moving surface. This type of low friction sealing arrangements are available commercially and do not per se form part of the present invention. However, they are advantageously used in the implementation of the present invention.

In the foregoing description most of the key operating parts were described; however, certain less critical parts were not discussed in detail, and some of these will now be mentioned. Specifically, with reference to FIG. 2, the poppet valve assembly 58 was referenced but some of the associated parts were not specifically mentioned. In particular, the poppet valve retainer body 182 was not previously specifically mentioned. This retainer body 182 is held in position by the threaded retainer ring 184, and the outer threaded retainer plate 186 which is provided with a large number, such as eight exhaust holes 188, completes the structure at the upper end of the reciprocator assembly. In order to permit the exhaust of air from the housing 22, the cap 24 is also provided with a large number of peripheral openings 190. In addition, adjacent the openings 190 is a rubber pad 192 of washer-shaped configuration, against which the reciprocator assembly may impinge, in the unusual case in which it is forced to its extreme upper position.

We will now return to consider the angled face 130 on the housing (see FIGS. 1 and 4), which is useful in connection with driving fasteners near the corner of a room as shown in FIG. 9. In order to avoid interference with the handle, as the housing is brought into contact or immediate proximity with the adjacent wall, the handle should be oriented at least 90° around the axis of the main portion of the housing, and preferably on the side of the housing opposite the slanted face 130 on the housing. Also, the angle of the face 130 with respect to the axis of the drive piston should be approximately equal to the difference between the angles of the faces 80' and 80'' of the dimpler surface 80 with respect to the axis of the drive piston. In the present instance, this is confirmed by the difference between 14° and 9°, or between 76° and 81° being equal to 5°, the angle of face 130. On a more general basis, the angles may be varied somewhat but should be coordinated for optimum results. Thus, if the 9° angle is varied by plus or minus two degrees, from 7° to 11°, corresponding to 83° to 79° angles, respectively, with the piston axis, and if the other face of the dimpler makes an angle which is 3° to 7° greater, and the angle of tilt of the face 130 is substantially equal to this three to seven degree difference, then the other angle would have a value which could range from about 10° up to about 18°, and still provide substantially equal dimple geometries for both vertical and tilted fasteners driving orientations.

The present pneumatic fastener driving tool would also be applicable to the driving of fasteners which have flush fastener heads, and do not require dimpling of the type described in detail hereinabove. For driving pins into concrete, or other similar work not requiring dimpling, the movable forward dimpling member would be replaced by a fixed stop, and the driving piston would be arranged to have a driving stroke just sufficient to properly drive the pin or nail the desired depth into the work, and would then impinge on the fixed stop and substantially concurrently against the resilient and positive stop members of the reciprocator.

Alternate Embodiment

Figure 15:
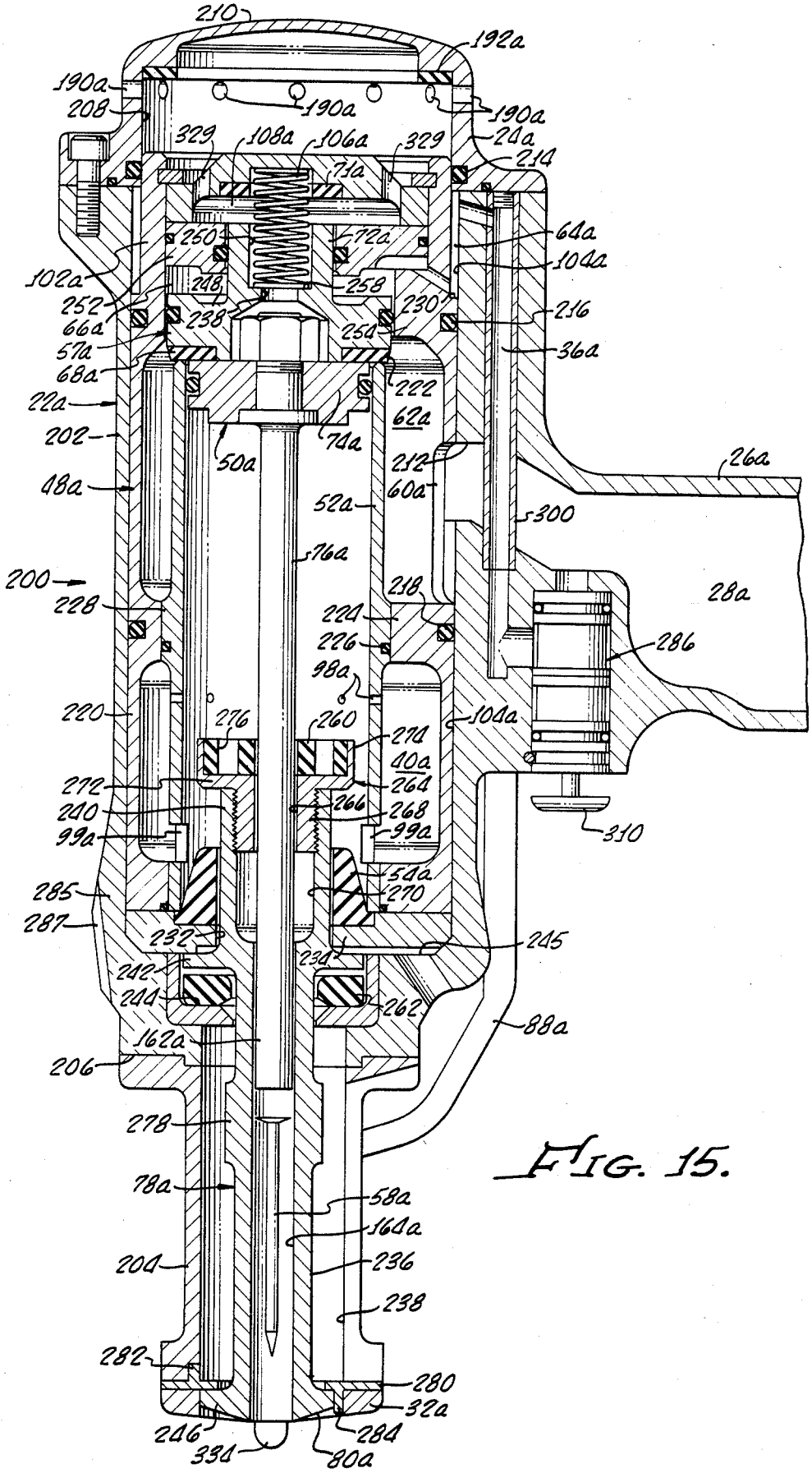
FIG. 15 is a cross-sectional view through an alternate, greatly preferred embodiment of the tool, with its components in their ready-to-fire positions, the fastener-feeding mechanism not being illustrated.

Illustrated in FIG. 15 is an alternate and greatly preferred embodiment 200 of the previously described tool. Although the tool 200 has several major improvements which are described below, many of its components are similar to those of the tool of FIG. 1 in both structure and function. For ease of comparison, such similar components have been given reference numerals identical to the corresponding components of the tool of FIG. 1, but with the suffix "a" added. The fastener-feeding apparatus of the tool 200 is also similar to that of the previously described tool embodiment, but is neither shown in FIGS. 15–20 nor discussed in the following description which is directed primarily to the structural improvements to the tool 200, and its novel recoil-controlling mechanism.

Basic Structure of the Tool 200

Referring to FIG. 15, which cross-sectionally illustrates the components of the tool 200 in their "ready-to-fire" positions, the tool 200, like the tool of FIG. 1, includes a metal (or plastic) housing **22*a* having an elongated generally cylindrical head portion 202, a handle portion 26*a* extending radially outwardly from the head portion, and a nose portion 204 extending axially outwardly from the lower or forward end 206 of the head 202**.

Formed within the head 202 is an axially extending cylindrical recoil chamber **104*a* having a reduced diameter upper portion 208 adjacent the upper end 210 of the head 202. A reservoir chamber 28*a* adapted to receive high pressure air from a source is formed in the handle 26*a* and communicates with the chamber 104*a* through an internal housing passage 212**.

Slidably mounted in the chamber **104*a* by means of Teflon O-ring seals 214, 216 and 218 are recoil-receiving and controlling means in the form of a metal reciprocator assembly 48*a* comprising a cylindrical body 220, an internal drive cylinder 52*a* telescoped longitudinally upwardly into the body 220 and having an open upper or inner end 222, and an internal poppet valve 57*a***.

An upper end portion of the cylinder 52 is enveloped by an annular surge chamber **62*a* formed within the reciprocator body 220 and communicating with the housing passage 212 through a side inlet port 60*a* formed in the body 220. Also formed within the body 220, and positioned below the surge chamber 62*a*, is a compression or return chamber 40*a* which circumscribes a lower portion of the internal cylinder 52*a*. The surge chamber 62*a* is isolated from the compression chamber 40*a* below it by means of an internal reciprocator body flange 224 which engages an O-ring seal 226 on a radially enlarged annular exterior portion 228 of the internal cylinder 52*a***.

The reciprocator body 220 has a lower portion slidably received in the lower portion of the housing chamber **104*a*, and a reduced diameter upper end portion 102*a* which is slidably received in the reduced diameter upper portion 208 of the chamber 104*a*. At the juncture of the lower and upper portions of the reciprocator body 220 is an annular, upwardly facing ledge 230 which functions, as described below, to return the reciprocator assembly 48*a* to its ready-to-fire position wherein the lower end of the body 220 is adjacent the lower end of the chamber 104***a*.

Slidably mounted within the internal drive cylinder 52*a* is a drive piston 74*a* upon which is mounted a downwardly projecting fastener-striking rod 76*a*. In its ready-to-fire position, the drive piston 74*a* is at the upper end of the internal cylinder 52*a*. The lower end of the rod 74*a* projects through an axial opening 232 in the lower end of the reciprocator body 220, the opening 232 being defined by an axially inwardly directed annular flange 234 on the bottom end of the reciprocator body.

One of the major structural changes in the tool 200 is in its dimpler mechanism 78*a* which includes an elongated dimpler member or shaft 236 mounted on the tool 200 for limited longitudinal reciprocating movement along the axis of movement of the piston 74*a*, the piston movement axis being laterally offset relative to the movement axis of the reciprocator assembly.

The dimpler shaft 236 extends longitudinally through an opening 238 extending axially through the housing nose portion 204, with a transversely enlarged upper end portion 240 of the dimpler shaft being slidably received in the lower reciprocator body end opening 232 and projecting upwardly into the internal cylinder 52*a*. The lower end portion of the dimpler shaft extends through an opening 238 extending axially through the housing nose portion 204. At the juncture of the upper and lower end portions of the dimpler shaft is a radially outwardly projecting external flange 242 which is positioned and captively retained between the lower end of the reciprocator body and an internal shoulder 244 formed in the housing below the bottom end of the chamber 104*a*. At the lower end of the dimpler shaft is an external flange 246 having a downwardly facing work-engaging face 80*a*. An axially extending opening 164*a* is formed through the entire length of the dimpler shaft and slidably receives a lower portion of the fastener-striking rod 76*a* as indicated in FIG. 15. For reasons described below, the work-engaging end face 80*a* of the dimpler shaft tapers uniformly upwardly and radially outwardly (at an angle of approximately 16°) from around the perimeter of the axial shaft opening 164*a*.

The poppet valve 57*a* has a cylindrical base 248, a reduced diameter central cylindrical boss 72*a* extending upwardly from the base, and an axial passage 250 extending from the underside of the base to the upper end of the boss. The poppet valve is slidably mounted within the reciprocator body for axial reciprocating movement therein between the upper end 222 of the internal cylinder 52*a* and the underside of an internal flange 252 within the reciprocator body 220. Above the flange portion 252 is a relief chamber 108*a* within the reciprocator body which communicates with the reduced diameter upper chamber portion 208. The valve boss 72*a* is slidably received in an opening defined by the internal flange 252, and the valve base 248 is slidably received within an internal flange portion 254 of the housing head positioned below the flange portion 252.

With the poppet valve in its ready-to-fire position, an annular seal 68*a* on the underside of the valve base seats against the upper end 222 of the internal cylinder 52*a* and isolates the interior of the cylinder from the surge chamber 62*a*. With the poppet valve in this position, a valve control chamber 66*a* is formed between the upper end of the valve base 248 and the underside of the internal flange portion 252. An annular O-ring seal 256 on the valve base 248 isolates the valve control chamber 66*a* from the surge chamber 62*a*. The poppet valve is biased downwardly toward its ready-to-fire position by a helical compression spring 106*a* extending between the upper end of the reciprocator body 220 and an interior shoulder 258 within the valve boss 72*a*.

In addition to the resilient washer 192*a* positioned at the upper end of the chamber 104*a*, which precludes potential rigid impact between the reciprocator assembly and the upper end of the housing head portion, and the resilient bumper 54*a* carried by the reciprocator assembly, the tool 200 has additional resilient means which prevents rigid collisions between and among the housing, the fastener driving means (i.e., the piston 74*a* and the striking rod 76*a*), and the dimpler means 78*a* upon firing of the tool. These additional resilient means include annular bumpers 260 and 262.

The annular bumper 260 circumscribes and slidably receives the fastener striking rod 76*a* and is positioned at the upper end of the dimpler shaft 236 by means of a mounting member 264. The mounting member 264 has an axially extending opening 266 through which the fastener striking rod 76*a* extends, and a downwardly extending, externally threaded boss 268 which is threaded into an enlarged upper end portion 270 of the axially extending dimpler passage 164*a*. The mounting member 264 has a circular horizontally extending base flange 272 which projects radially outwardly of the upper end of the dimpler shaft around its perimeter. Extending upwardly from the perimeter of the base flange 272 is a support flange 274 which forms with the base flange 272 an annular channel in which the bumper 260 is received and supported. For reasons described below, a circumferentially spaced series of axially extending openings 276 are formed through the bumper 260. As will be seen, the bumper 260 functions to prevent rigid contact between the piston 74*a* and the dimpler shaft 236, while the bumper 54*a* positioned below the base flange 72 functions, in part, to prevent rigid impact between the mounting member 264 and the housing flange 234.

The annular resilient bumper 262 also circumscribes the dimpler shaft 236 and is interposed between the dimpler flange 242 and the interior housing shoulder 244 below it. It should be noted that the dimpler flange 82*a* in the tool 200, which is used to control the depth of the drywall dimple, has been relocated from adjacent the lower end of the dimpler shaft to the intermediate longitudinal position indicated in FIG. 15. It will be seen that the annular bumper 262 prevents the rigid impact between the flange 82*a* and the housing which was present between the flange 82 and the housing in the previously described tool.

At this point another modification of the tool's bumper system should be noted. In the tool 200, upturned stop or flange 56 (FIG. 1) whose upper end was positioned just below the upper surface of the bumper 54, has been eliminated and the bumper 54 (54*a* in FIG. 15) has been radially inwardly thickened and somewhat shortened. As will be seen, this elimination of the flange 56 eliminates the rigid stopping surface which was presented when the bumper 54 was slightly downwardly deflected.

By means of the fastener-feeding system (not shown in FIG. 15), the drywall nail 58*a* is pneumatically fed into the axial dimpler shaft passage 164*a* through a slot (also not shown in FIG. 15) in the dimpler shaft. Such slot is transversely widened to accept the head of the nail. To strengthen the dimpler shaft in the vicinity of this widened slot area, a circumferential enlargement 278 is formed on the dimpler shaft. To prevent the dimpler shaft from rotating about its longitudinal axis (which would rotate the nail-receiving slot out of its necessary nail-receiving position), a metal washer 280, which circumscribes the dimpler shaft just above the lower dimpler flange 246, is interposed between the dimpler cap 32*a* and the lower end of the housing nose portion 204 through which the dimpler cap is secured. The washer 280 has an upturned lug 282 which is received in a corresponding slot in the housing nose portion 204 to prevent relative rotation between the washer 280 and the nose portion 204. A downturned lug 284 is slidably received in a peripheral notch formed in the lower dimpler flange 246 to prevent rotation of the dimpler shaft relative to the nose portion 204.

In the tool 200, the housing head portion and the reciprocator body are not tapered inwardly to provide the structural means for positioning and guiding the tool against a corner wall of a room to properly drive fasteners and form dimples at such corner. Instead of such tapering of the housing and reciprocator, such structural means in the tool 200 comprise an enlarged lower side portion 285 of the housing head portion which has a downwardly and inwardly sloping wall-contacting face 287 which faces away from the handle 26*a*. It is this face which is positioned against a corner wall to properly position the tool to drive fasteners into and dimple the drywall sheet extending perpendicularly to the guiding wall.

As illustrated in FIGS. 19 and 20, the actuation means of the tool 200 include generally cylindrically shaped first and second pneumatic valves 286, 288 received, respectively, in cylindrical openings 290, 292 formed in the underside of the handle 26*a* adjacent the housing head portion 202.

The valve 286 has an upper end inlet 294 which communicates with the handle reservoir chamber 28*a* via a passage 296 formed in the handle, a first sidewall port 298 which communicates with an air tube portion 300 of the control passageway 36*a* through a handle passage 302, and a second sidewall port 304. The port 298 is offset upwardly of the port 304 and is separated therefrom by a valve seat having a central axial opening 306. Positioned above the valve seat is an internal valve chamber 308 which opens outwardly through the inlet 296 and the side port 298. The side port 304 communicates with the chamber 308 through the valve seat opening 306. Control means for the valve 286 include a manually operable plunger 310 slidably received within the valve, and a ball 312 positioned within the chamber 308.

The valve 288 has an upper end portion 314 which is transversely reduced relative to the handle opening 292 and is positioned slightly below its upper end, thereby defining an air passageway 316 which envelopes the upper valve end 314. An internal chamber 318 in the valve 288 opens outwardly through an upper end valve inlet 320 and a side outlet valve port 322. Interposed between the valve inlet and outlet 320, 322 is a valve seat having a central opening 324 formed therethrough. The side outlet port 322 communicates with atmosphere through a vent passage 326 formed in the handle 26*a*. Control means for the valve 288 include a plunger 328 slidably received within the valve 288, and a ball 330 within the chamber 318, the ball 318 being biased into the valve seat opening by a compression spring 332 within the chamber 318.

The lower end of the plunger 328 has a slot in it which receives the upper end of the safety interlock member or probe 88*a*. The upper probe end is retained in such slot by suitable means such as a pin 332. The lower or forward end 334 of the probe (FIG. 15) is slidably received in a slot formed through the lower flanged end of the housing nose portion 204 and the dimpler cap 32*a* (see FIG. 19) and projects forwardly of the dimpler cap as shown in FIG. 15. It should be noted that the probe 80*a*, unlike the probe 88 of the previously described tool, is not interconnected to the dimpler shaft 236, but functions independently of it. Thus, as the dimpler cap 32*a* is pressed into engagement with a workpiece, the probe is pushed upwardly, thereby depressing the plunger 328 of the second or safety valve 288. The valve spring 332 in the safety valve 288, which biases the ball 330 downwardly into engagement with the upper end of the plunger 328, also biases the probe to its forward-most position indicated in FIG. 15.

The valves 286, 288 are pneumatically connected in series by means of an air passage 336 formed in the handle 26*a* and communicating the side port 304 of the valve 286 with the inlet opening 320 of the valve 288 via the air passage 316 which envelopes the upper end portion 314 of the valve 288. As described below, the series interconnection of the valves 286, 288 requires that both of the plungers 310, 328 be depressed in order to vent the poppet valve control chamber 66*a* (FIG. 15) to actuate the tool 200.

Because of factors including the locations and constructions of the described bumpers or pads, tool 200 has a life surprisingly and dramatically greater than that of the previous embodiment.

Method of Operation

FIGS. 15 through 18 depict, in sequence, four positions of the components of the tool 200 during a single firing and reset cycle thereof. Before describing the operation of the improved and currently preferred tool 200, it should be noted that it has recoil-delaying and reducing characteristics at least equal to those of the previously described tool. More specifically, the reciprocator assembly and fastener-driving means of the tool 200 cooperate during and subsequent to the actual driving of the fastener 58*a* to substantially eliminate rearward recoil of the housing (i.e., the recoil sensible by an operator of the tool) during the forward driving stroke of the piston 74*a*, and to minimize housing recoil subsequent to such driving stroke.

Referring first to FIG. 15, in which the components of the tool 200 are in their ready-to-fire positions, high pressure air fills the reservoir chamber 28*a*, the surge chamber 62*a*, and the interconnecting internal passage 212. This high pressure air is communicated to the poppet valve control chamber 66*a* and the annular chamber 64*a* circumscribing the upper end portion 102*a* of the reciprocator through the passageway system 36*a*. A supply tube portion 300 of the passageway system 36*a* receives high pressure air from the reservoir chamber 28*a* which enters the inlet 294 of the valve 286 and forces the ball 312 (FIG. 20) downwardly into the valve seat opening 306. The air exits the valve side port 298 and enters the supply tube 300 via the handle passage 302. The high pressure air in the poppet valve control chamber 66*a*, coupled with the biasing force of the poppet valve spring 106*a*, forces the poppet valve downwardly into its sealing position against the upper end 222 of the internal reciprocator cylinder 52*a*.

Although the high pressure air in the surge chamber 62*a* exerts an upward force upon a small peripheral area of the poppet valve 57*a*, it can be seen that the horizontal valve area upon which this pressure force acts is considerably less than the horizontal valve body area upon which the high pressure air in the control chamber 66*a* exerts a downward force. This larger downward force, coupled with the downward spring force on the poppet valve, holds the valve in its cylinder-sealing position. The axially extending poppet valve opening 250 is vented to atmosphere via the relief chamber 108*a*, vents 329 formed in the upper end of the reciprocator body 220, and the upper housing outlet ports 190*a*. Air at atmospheric pressure is present within the internal reciprocator cylinder 52*a* and the compression chamber 40*a* surrounding it. The interior of the cylinder 52*a* communicates with the compression chamber 40*a* through the small cylinder ports 98*a*, and the larger cylinder ports 99*a* below them, formed through the cylinder wall.

Figure 16:
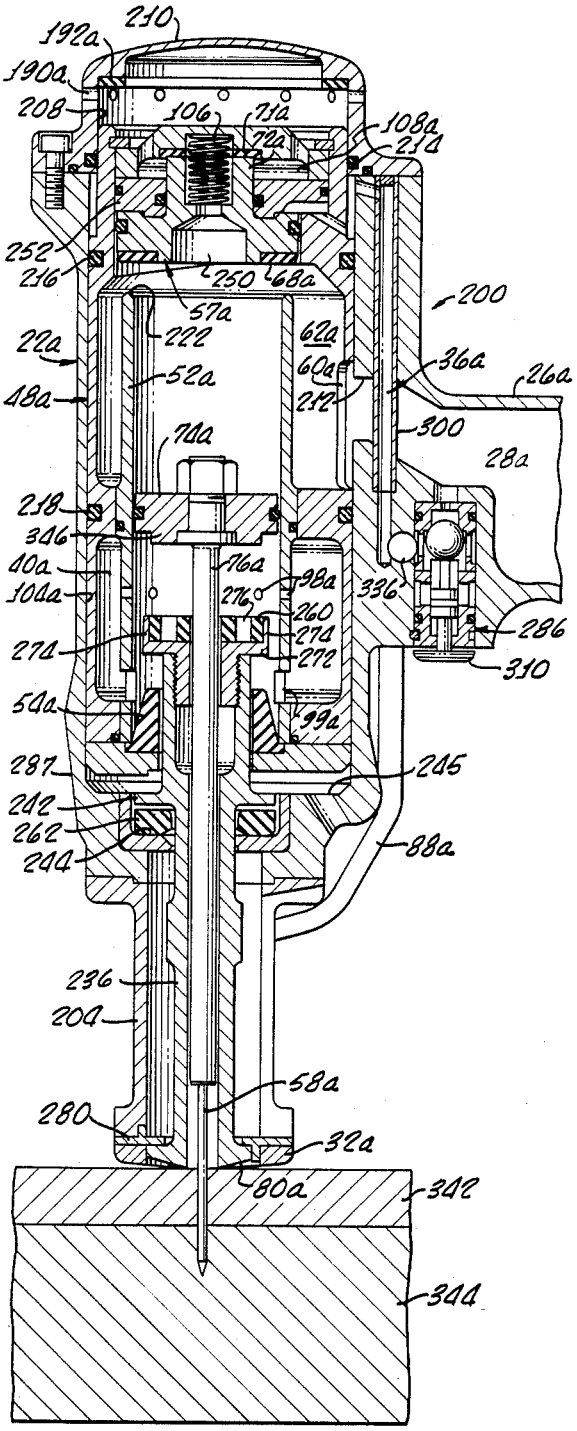
FIG. 16 is a reduced scale cross-sectional view through the tool during driving of a fastener into a drywall sheet and underlying framing stud.

Referring now to FIG. 16, which depicts the positions of the tool components just subsequent to firing, the dimpler plate 32*a* having been pressed against the outer surface 340 of a drywall sheet 342, thus forcing the drywall sheet into firm abutment with one of its underlying framing studs 344. This pressing of the dimpler plate against the outer drywall surface forces the forward probe end 344 (FIG. 15) rearwardly, thereby depressing the plunger 328 of the safety valve 288. Additionally, the plunger 310 of the valve 286 has been manually depressed. With both of the plungers depressed (as indicated by the dashed arrows on the plungers in FIG. 20) the ball 312 is pushed upwardly by the plunger 310 and seals the valve inlet 294, and the ball 330 is pushed upwardly, unblocking the valve seat opening 324.

Air in the passageway system 36*a* is then vented through the air tube 300 into the chamber 302, and then is vented through the handle vent opening 326 via the valve port 298, the valve port 304, the interconnecting passage 336, and the outlet port 322, all as indicated by dashed arrows in FIG. 20.

This venting of the passageway system 36*a* rapidly reduces the pressure in the poppet valve control chamber 66*a* which allows the high pressure air in the surge chamber 62*a* (FIG. 16) to thrust the poppet valve 57*a* upwardly against the internal flange 252 against the resistance of the compression spring 106*a*. When the poppet valve reaches this upper position, the upper end of the valve boss 72*a* seals against a sealing ring 71*a* carried by the upper end of the reciprocator body. This sealing precludes upward passage of air through the poppet valve opening 250 into the relief chamber 108*a*.

The upward movement of the poppet valve unseats its seal 68*a* from the upper end 222 of the internal reciprocator cylinder 52*a*, which allows the high pressure air in the surge chamber 62*a* to very rapidly enter the cylinder 52*a* and thrust the piston 74*a* downwardly through its driving stroke.

The entrance of the surge chamber air into the cylinder 52*a* simultaneously causes the reciprocator assembly 48*a* to reactively recoil upwardly in the chamber 104*a* away from its ready-to-fire position against the bottom end 245 of the chamber 104*a*. The mass of the reciprocator assembly 48*a* is approximately six times that of the combined masses of the piston 74*a* and the fastener-striking rod 76*a*. Therefore, the initial downward acceleration of the piston is approximately six times that of the initial upward acceleration of the reciprocator assembly. Thus, as indicated in FIG. 16, just subsequent to firing, the downward travel of the piston is greatly larger than the reactive upward travel of the reciprocator assembly.

It is an important aspect of the present invention that during the driving stroke of the piston 74*a*, no appreciable rearward recoil of the housing occurs. Thus, during the driving stroke, the dimpler plate 32*a* (nose piece) may be hand-held in firm engagement with the outer surface 340 of the drywall sheet 342 as indicated in FIG. 16.

This very desirable feature of the tool 200 (as in the previously described tool) is obtained by a unique cooperation between the reciprocator assembly and the piston during the driving stroke. More specifically, during the piston's driving stroke, the reciprocator assembly functions as a movable firing base from which the piston is thrust. The reactive recoil energy of the downwardly moving piston is transmitted not to the housing but substantially entirely to the reciprocator assembly. The upwardly moving reciprocator slides along the inner surface of the recoil chamber 104*a* on its low-friction Teflon seals 214, 216, 218 without impinging in any manner upon the housing. This smooth sliding of the reciprocator is further enhanced in the tool 200 by anodizing the inner surface of the chamber 104*a*. If the materials are such that the sliding is along plastic instead of metal, a surface treatment of molybdenum dry lube may be used. Because of the plurality of outlet ports 190*a* formed through the upper end of the housing head portion, the upwardly moving reciprocator assembly forces air above it in the chamber 104*a* to atmosphere without causing a pneumatic impact upon the housing. Thus, during the piston's driving stroke, the reciprocator and the piston cooperate to prevent sensible tool recoil during the driving stroke.

As the piston 74*a* is driven downwardly by the high pressure surge chamber air, the cylinder air in front of the piston is compressed and driven outwardly through the cylinder ports 98*a*, 99*a*, in turn pressurizing the air in the compression chamber 40*a*. This pressurized air in the compression chamber is used to operate the fastener-feeding means as previously described, and is also used to return the piston 74*a* to its ready-to-fire position as described below.

Figure 17:
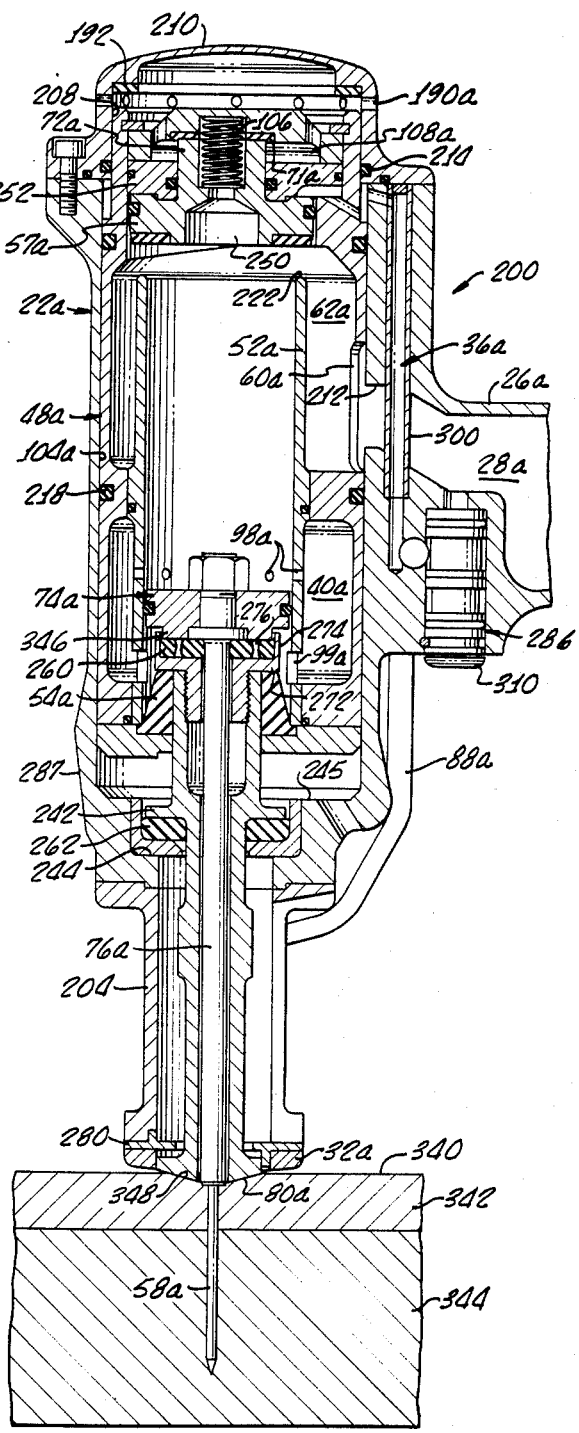
FIG. 17 is a view similar to FIG. 16 showing the tool's components at the completion of the fastener-driving stroke of the piston.

As the piston 74*a* continues its downward travel and acceleration, the fastener-striking rod 76*a* next strikes the head of the nail 58*a* and begins to drive it into the drywall sheet 342 and the underlying framing stud 344 as illustrated in FIG. 16. While the rod 76*a* is driving the nail into the drywall, a downwardly projecting, reduced diameter cylindrical portion 346 of the piston 74*a*, which has a diameter slightly less than the inner diameter of the upturned dimpler flange 274, strikes the upper dimpler bumper 260, driving the dimpler shaft 236 downwardly. This, in turn, forces the work engaging surface 80*a* of the dimpler shaft into the drywall to form the drywall surface dimple 348 (FIG. 17) as the nail is being recessed by the rod 76*a* at the end of the piston's driving stroke. The upper bumper 260 is axially compressed by the piston portion 346 and the bumper material is forced horizontally into the circumferentially spaced openings 276 as indicated in FIG. 17. The intermediate dimpler flange 242 is driven downwardly against and compresses the bumper 262 which prevents rigid contact between the flange 82 and the housing, the piston not quite striking the upper end of the upturned dimpler flange 274. The bumper 262 additionally functions to control the depth of the dimpler, the thicker the bumper, the shallower the dimple, and vice versa.

The impact between the downwardly facing central piston portion 346 and the dimpler bumper 260 occurs at the very end portion of the piston's fastener-driving stroke. At or very shortly after the simultaneous completion of the fastener-driving and the dimpling strokes, at which time the piston and the dimpler shaft are essentially stationary, having driven and recessed the nail, and formed the dimple, the still upwardly traveling reciprocator bumper or energy-absorbing means 54*a* strikes the underside of the horizontally extending support member flange 272. The bumper 54*a* is compressed, and slightly retracts both the dimpler shaft and the piston as the reciprocator assembly continues to move upwardly. The collision between the bumper 54*a* and the flange 272 is entirely resilient due to the absence of the upturned flange 56 (FIG. 1).

When the bumper 54*a* strikes the dimpler flange 272, it pneumatically seals the reciprocator assembly, causing it to become, in effect, a closed vessel so that high pressure air in the reservoir chamber 28*a* communicating with the surge chamber 62*a* no longer exerts a propelling force on the reciprocator assembly. Thus, at this point, no further recoil energy (which ultimately must be dissipated) is added to the reciprocator assembly.

The collision between the reciprocator bumper 54*a* and the stationary reciprocator shaft and piston, which transfers a portion of the reciprocator's kinetic or recoil energy to the bumper 54*a*, aids in stopping the upward travel of the reciprocator within the chamber 104*a*. The balance of the reciprocator's kinetic energy is frictionally transferred to the housing, without impact therewith, and the recoil of the housing subsequent to the fastener-driving and dimpling strokes is thus significantly reduced. Stated otherwise, the final stopping of the reciprocator is accomplished frictionally, the upwardly moving reciprocator being stopped before it strikes the upper housing bumper 192*a*. Thus, the recoil energy arising from the driving of the piston 74*a* is both received and controlled by the reciprocator assembly which cooperates with the piston 74*a* to preclude appreciable recoil of the housing during the piston's driving stroke, and to subsequently cooperate with the piston to smoothly dissipate the recoil energy in the reciprocator assembly without impingement between the reciprocator and the housing, thus minimizing subsequent housing recoil.

As indicated in FIG. 18, to reset the tool 200, the plunger 310 is released. When this is done, high pressure air in the reservoir chamber 28*a* forces the ball 312 downwardly into sealing engagement with the valve seat opening 306 and allows the air in the chamber 28*a* to flow into the valve inlet 294, through the side valve port 298 and upwardly through the supply tube 300. This air then forces its way into the annular chamber 64*a* and thence into the poppet valve control chamber 66*a*.

The high pressure air in the annular chamber 64*a* operates upon the upwardly facing reciprocator ledge 230 to return the reciprocator assembly downwardly toward its ready-to-fire position as indicated in FIG. 15. The high pressure air entering the poppet valve control chamber 66*a* also drives the poppet valve 57*a* downwardly into sealing engagement with the upper end 222 of the internal cylinder 52*a*. This, in turn, vents the high pressure air within the cylinder through the poppet valve opening 338, the relief chamber 208, and the upper outlet ports 190*a* in the housing. The pressurized air in the compression chamber 40*a* then flows through the lower cylinder ports 99*a* and exerts an upward force on the underside of the piston 74*a* to move it upwardly toward its ready-to-fire position (as indicated in FIG. 18) against the underside of the poppet valve.

The foregoing detailed description is to be clearly understood as given by way of illustration and example only, the spirit and scope of this invention being limited solely by the appended claims.

I claim:

1. Apparatus for effecting single-stroke driving of a fastener into a workpiece, said apparatus comprising:

(a) a relatively light-weight, portable housing, (b) piston means movably mounted in said housing and associated with fastener-driver means for single-stroke driving of a fastener into a workpiece when said piston means is pneumatically actuated in a direction toward said workpiece, (c) means to deliver high-pressure air to the side of said piston means remote from said workpiece, to thus effect said pneumatic actuation, (d) reciprocator means movably mounted in said housing for movement in a direction away from said workpiece in response to said delivery of high-pressure air, and (e) means, operative when (1) said fastener has been substantially completely driven into said workpiece, and (2) said reciprocator means is moving in a direction away from said workpiece to provide a mechanical stopping relationsip between said piston means and said reciprocator means, said mechanical stopping relationship being such that said piston means, when at or near the bottom of its stroke and relatively adjacent said workpiece, provides at least a substantial degree of stopping action on said thus-moving reciprocator means.

2. The invention as claimed in claim 1, in which said reciprocator means is a hollow element which contains cylinder means, said cylinder means receiving said piston means (b).

3. The invention as claimed in claim 2, in which means are provided to create a fluid sealing relationship causing said reciprocator means to become a sealed vessel when said piston means is at or near the bottom of its stroke, thus preventing additional pneumatic propelling actuation of said reciprocator means in a direction away from said workpiece.

4. The invention as claimed in claim 3, in which combination bumper and sealing means are provided between said dimpler means and said reciprocator means, said combination bumper and sealing means performing the dual function of (1) causing said reciprocator means to become a sealed vessel, and (2) effecting said mechanical stopping relationship recited in clause (e) in the absence of excessive mechanical shock.

5. The invention as claimed in claim 4, in which said apparatus further comprises bumper means on the end of said dimpler means remote from said workpiece, and adapted to be engaged by said piston means with minimized shock.

6. The invention as claimed in claim 1 in which said reciprocator means is slidably mounted within said housing using low friction material so that there is a relatively small amount of transmission of kinetic force from said reciprocator means to said housing, while said reciprocator means moves in a direction away from said workpiece.

7. The invention as claimed in claim 6, in which the relationship between said reciprocator means and said housing is such that said reciprocator means is, during normal operation of the apparatus, positively stopped by a portion of said housing at the end of the travel of said reciprocator means in a direction away from said workpiece.

8. The invention as claimed in claim 6, in which the pneumatic relationship between said reciprocator means and said housing is such that there is only a small pneumatic impact between said reciprocator means and said housing during travel of said reciprocator means in a direction away from said workpiece.

9. The invention as claimed in claim 1, in which dimpler means are provided to form a dimple in the workpiece around said fastener, said dimpler means being disposed to be engaged by said piston means in order to effect said dimpling, said dimpler means having a portion that operates, when said dimpler means is at or near the bottom of its stroke, to aid in forming a fluid seal relationship between said piston and said reciprocator.

10. The invention as claimed in claim 1 in which the relationship between said reciprocator means and said housing is such that said reciprocator means is, during normal operation of the apparatus, positively stopped by a portion of said housing at the end of the travel of said reciprocator means in a direction away from said workpiece.

11. The invention as claimed in claim 10 in which the pneumatic relationship between said reciprocator means and said housing is such that there is only a small pnuematic impact between said reciprocator means and said housing during travel of said reciprocator means in a direction away from said workpiece.

12. A pneumatic hand tool for driving fasteners comprising:

(a) a housing adapted to be grasped by an operator, said housing having a front portion with an outer end surface, a passage formed in said front portion and opening outwardly through said outer end surface, and a chamber formed in said housing, said chamber being positioned rearwardly of and communicating with said passage;

(b) fastener-driving means mounted in said chamber for forward movement from a ready-to-fire position through a single driving stroke to drive a fastener placed in said passage outwardly therethrough into a workpiece against which said outer end surface is placed;

(c) selectively operable means for utilizing a source of pressurized gas to actuate said fastener driving means through said driving stroke; and (d) recoil-controlling means, slidably mounted in said chamber and having forwardly positioned stop means, for cooperating with said fastener driving means during and subsequent to said driving stroke to substantially preclude rearward recoil of said housing during said driving stroke, whereby said outer end surface may be hand-held in contact with a workpiece during substantially the entirety of said driving stroke, and to significantly reduce rearward recoil of said housing subsequent to said driving stroke, a portion of said fastener-driving means being slidably received within said recoil-controlling means and captively retained therein by said stop means.

13. The tool of claim 12 wherein the weight of said recoil-controlling means is substantially greater than the weight of said fastener-driving means.

14. The tool of claim 13 wherein the ratio of said weight of said recoil-controlling means to said weight of said fastener-driving means is approximately six to one.

15. The tool of claim 13 wherein the ratio of said weight of said recoil-controlling means to said weight of said fastener-driving means is approximately eight to one.

16. The tool of claim 12 wherein said recoil-controlling means comprises a unitary reciprocator assembly having an internal cylinder, said portion of said fastener driving means includes a piston mounted in said cylinder, said actuating means include means for injecting pressurized gas into said reciprocator assembly to drive said piston forwardly through said driving stroke and simultaneously reactively drive said reciprocator assembly rearwardly from a ready-to-fire position, and said stop means include a resilient bumper positioned to collide with said piston subsequent to said driving stroke and absorb recoil energy of said reciprotor assembly.

17. The tool of claim 12 further comprising means for pneumatically returning said fastener-driving means and said reciprocator assembly to ready-to-fire positions subsequent to said driving stroke.

18. The tool of claim 12 further comprising means responsive to said driving stroke of said fastener driving means for forming a dimple in a workpiece around a fastener driven from said tool into the workpiece.

19. The tool of claim 12 in which said portion of said fastener driving means is mounted for linear movement along an axis which is parallel to but laterally displaced from the axis of movement of said recoil-controlling means.

20. The tool of claim 12, further comprising means, including a collation, for feeding fasteners to said tool.

* * * * *